US011724528B2

(12) United States Patent
Miyagawa

(10) Patent No.: US 11,724,528 B2
(45) Date of Patent: Aug. 15, 2023

(54) SHEET SUCTION DEVICE, SHEET CONVEYOR, AND PRINTER

(71) Applicant: Hiroaki Miyagawa, Ibaraki (JP)

(72) Inventor: Hiroaki Miyagawa, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/511,565

(22) Filed: Oct. 27, 2021

(65) Prior Publication Data

US 2022/0161578 A1 May 26, 2022

(30) Foreign Application Priority Data

Nov. 20, 2020 (JP) ..... 2020-193194

(51) Int. Cl.
*B65H 5/22* (2006.01)
*B41J 13/22* (2006.01)

(52) U.S. Cl.
CPC ..... *B41J 13/226* (2013.01); *B65H 5/222* (2013.01); *B65H 2406/33* (2013.01)

(58) Field of Classification Search
CPC ..... B41J 13/226; B65H 5/226; B65H 5/222; B65H 2406/332; B65H 2406/361; B65H 2406/3612; B65H 2406/362; B65H 2406/3622; B65H 2511/10; B65H 2511/11; B65H 2511/12; B65H 2406/33
See application file for complete search history.

(56) References Cited

U.S. PATENT DOCUMENTS 9,315,331 B2 * 4/2016 Gieser ..... B41F 21/102
2019/0283415 A1 9/2019 Miyagawa et al.
2020/0039772 A1 2/2020 Miyagawa

FOREIGN PATENT DOCUMENTS

JP 2013-241272 12/2013
JP 2020-019637 2/2020

* cited by examiner

*Primary Examiner* — Luis A Gonzalez
(74) *Attorney, Agent, or Firm* — Xsensus LLP

(57) ABSTRACT

A sheet suction device includes a drum including multiple suction holes in a circumferential surface of the drum, the drum configured to bear a sheet on the circumferential surface and rotate, a suction device configured to suck the sheet through the multiple suction holes, a rotary valve between the multiple suction holes of the drum and the suction device, the rotary valve configured to rotate relative to the drum to change a number of the multiple suction holes communicating with the suction device, and a driver configured to relatively rotate the drum and the rotary valve.

7 Claims, 14 Drawing Sheets

SHEET SUCTION DEVICE, SHEET CONVEYOR, AND PRINTER

CROSS-REFERENCE TO RELATED APPLICATION

This patent application is based on and claims priority pursuant to 35 U.S.C. § 119(a) to Japanese Patent Application No. 2020-193194, filed on Nov. 20, 2020, in the Japan Patent Office, the entire disclosures of which is hereby incorporated by reference herein.

BACKGROUND

Technical Field

Aspects of the present disclosure relate to a sheet suction device, a sheet conveyor, and a printer.

Related Art

A printer includes a rotation member such as a drum and performs printing while bearing a sheet on the drum to convey the sheet, for example.

A sheet conveyor suctions and attracts the sheet on the drum to bear the sheet around a circumferential surface of the drum to convey the sheet.

SUMMARY

In an aspect of this disclosure, a sheet suction device includes a drum including multiple suction holes in a circumferential surface of the drum, the drum configured to bear a sheet on the circumferential surface and rotate, a suction device configured to suck the sheet through the multiple suction holes, a rotary valve between the multiple suction holes of the drum and the suction device, the rotary valve configured to rotate relative to the drum to change a number of the multiple suction holes communicating with the suction device, and a driver configured to relatively rotate the drum and the rotary valve.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
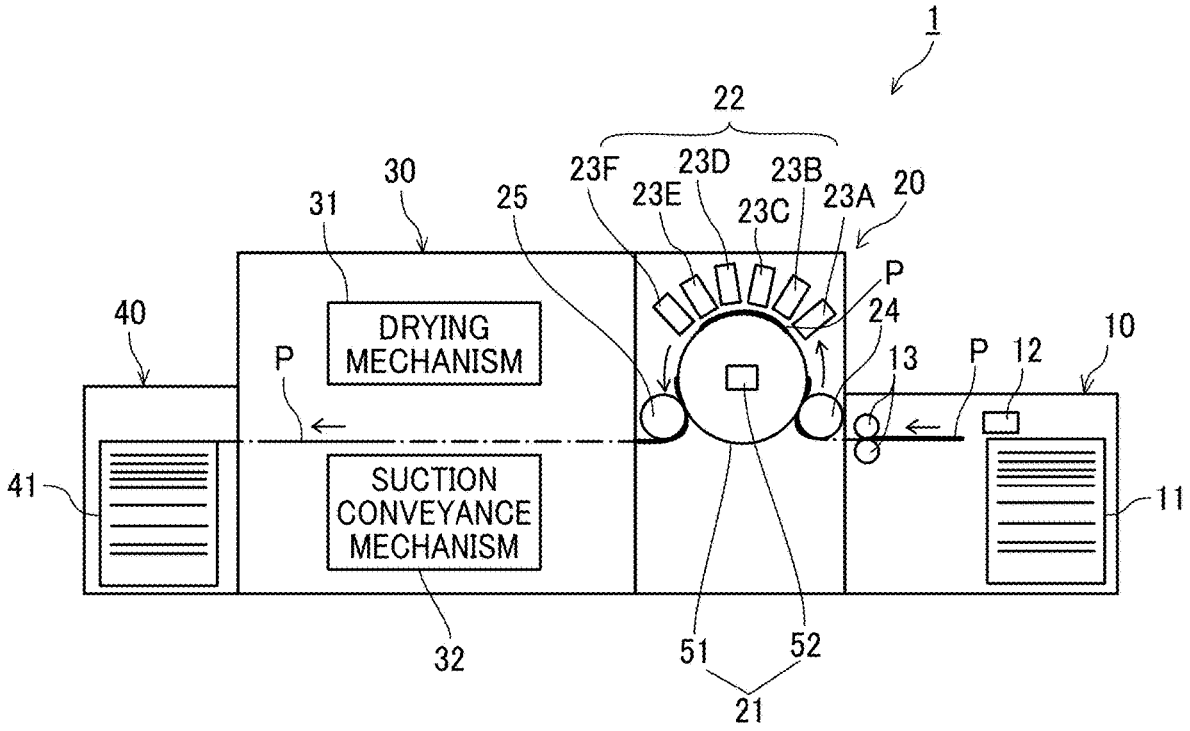
FIG. 1 is a schematic side view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

It will also be understood that when an element is referred to as being "connected" or "coupled" to another element, it can be directly connected or coupled to another element or intervening elements may be present. In contrast, when an element is referred to as being "directly connected" or "directly coupled" to another element, there are no intervening elements present. Thus, the term "connected/coupled" includes both direct connections and connections in which there are one or more intermediate connecting elements.

Referring now to the drawings, wherein like reference numerals designate identical or corresponding parts throughout the several views, embodiments of the present disclosure are described below. Next, a printer 1 according to a first embodiment of the present disclosure is described with reference to FIGS. 1 and 2.

FIG. 1 is a schematic side view of the printer 1 according to the first embodiment of the present disclosure.

Figure 2:
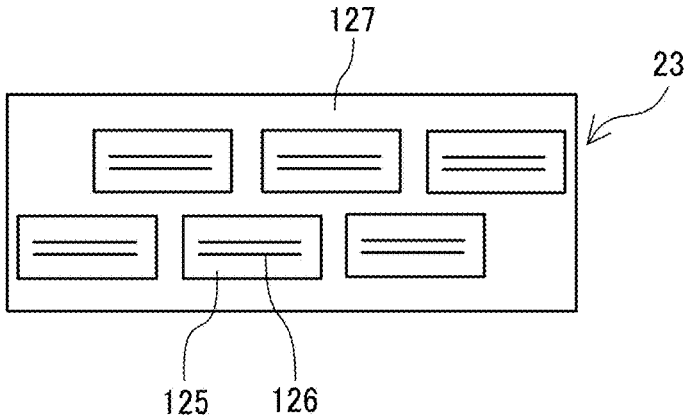
FIG. 2 is a plan view illustrating a liquid discharging unit of the printer of FIG. 1.

FIG. 2 is a plan view of an example of a discharge unit 23 of the printer 1.

The printer 1 includes a loading device 10, a printing device 20, a drying device 30, and an ejection device 40. The printer 1 applies a liquid to a sheet P conveyed from the loading device 10 by the printing device 20 to perform desired printing, dries the liquid adhering to the sheet P by the drying device 30, and ejects the sheet P to the ejection device 40.

The loading device 10 includes a loading tray 11 on which a plurality of sheets P are stacked, a feeding unit 12 to separate and to feed the sheets P one by one from the loading tray 11, and a resist roller pair 13 to feed the sheets P to the printing device 20.

Any feeding unit 12 such as a device using a roller or a device using air suction may be used as the feeding unit 12. The sheet P delivered from the loading tray 11 by the feeding unit 12 is delivered to the printing device 20 by the resist roller pair 13 being driven at a predetermined timing after a leading end of the sheet P reaches the resist roller pair 13.

The printing device 20 includes a sheet conveyor 21 to convey the sheet P. The sheet conveyor 21 includes a drum 51 and a suction device 52. The drum 51 is a bearer (rotating member) that bears the sheet P on a circumferential surface of the drum 51 and rotates while receiving power from a driver 58 such as a motor (see FIG. 4). The suction device 52 generates a suction force on the circumferential surface of the drum 51 to suck and attracts the sheet P toward the drum 51. The printing device 20 includes a liquid discharge device 22 that discharges the liquid toward the sheet P borne on the drum 51 of the sheet conveyor 21 to apply the liquid onto the sheet P.

The printing device 20 further includes a transfer cylinder 24 and a delivery cylinder 25. The transfer cylinder 24 receives the sheet P fed from the resist roller pair 13 and transfers the sheet P to the drum 51. The delivery cylinder 25 delivers the sheet P conveyed by the drum 51 to the drying device 30.

A leading end of the sheet P conveyed from the loading device 10 to the printing device 20 is gripped by a sheet gripper provided on a surface of the transfer cylinder 24 and is conveyed in accordance with a rotation of the transfer cylinder 24. The transfer cylinder 24 forwards the sheet P to the drum 51 at a position opposite (facing) the drum 51.

Similarly, the drum 51 includes a sheet gripper on a surface of the drum 51, and the leading end of the sheet P is gripped by the sheet gripper of the drum 51. Multiple suction holes are dispersedly formed on the surface of the drum 51. The suction device 52 generates a suction airflow from desired multiple suction holes of the drum 51 toward an interior of the drum 51. The suction device 52 serves as a suction device.

The sheet gripper 106 (see FIG. 5) of the drum 51 grips the leading end of the sheet P forwarded from the transfer cylinder 24 to the drum 51, and the sheet P is attracted to and borne on the drum 51 by the suction airflow generated by the suction device 52. As the drum 51 rotates, the sheet P is conveyed.

The liquid discharge device 22 includes discharge units 23 (23A to 23F) that discharge liquids. For example, the discharge unit 23A discharges a liquid of cyan (C), the discharge unit 23B discharges a liquid of magenta (M), the discharge unit 23C discharges a liquid of yellow (Y), and the discharge unit 23D discharges a liquid of black (K), respectively. Further, the discharge units 23E and 23F are used to discharge any one of YMCK or special liquid such as white and gold (silver). Further, the liquid discharge device 22 may further include a discharge unit to discharge a processing liquid such as a surface coating liquid.

The discharge unit 23 is a full line head and includes multiple liquid discharge heads 125 arranged in a staggered manner on a base 127 (see FIG. 2). Each of the multiple liquid discharge heads 125 includes multiple nozzle arrays 126 and multiple nozzles arranged in each of the multiple nozzle arrays 126, for example as illustrated in FIG. 2. Hereinafter, the "liquid discharge head 125" is simply referred to as a "head 125".

A discharge operation of each of the discharge units 23 of the liquid discharge device 22 is controlled by drive signals corresponding to print information. When the sheet P borne on the drum 51 passes through a region facing the liquid discharge device 22, the liquid of each color is discharged from the discharge units 23, and an image corresponding to the print information is printed on the sheet P.

The drying device 30 includes a drying mechanism 31 and a suction conveyance mechanism 32. The drying mechanism 31 dries the liquid adhered on the sheet P by the printing device 20. The suction conveyance mechanism 32 conveys (suctions and conveys) the sheet P while suctioning the sheet P conveyed from the printing device 20 onto the suction conveyance mechanism 32.

After the sheet P conveyed from the printing device 20 is received by the suction conveyance mechanism 32, the sheet P is conveyed to pass through the drying mechanism 31 and delivered to the ejection device 40.

When the sheet P passes through the dying mechanism 31, the liquid on the sheet P is subjected to a drying process by the drying mechanism 31. Thus, the liquid component such as water in the liquid evaporates. The colorant contained in the liquid is fixed on the sheet P. Thus, curling of the sheet P is reduced.

The ejection device 40 includes an ejection tray 41 on which a plurality of sheets P are stacked. The sheets P conveyed from the drying device 30 are sequentially stacked and held on the ejection tray 41 of the ejection device 40.

The printer 1 can further include, for example, a pretreatment device disposed upstream from the printing device 20, or a post-processing device disposed between the drying device 30 and the ejection device 40. The pretreatment device performs pretreatment on the sheet P. The post-processing device performs post-processing of the sheet P to which the liquid has been applied.

For example, the pre-processing device may perform a pre-application process that applies a treatment liquid onto the sheet P before image is printed on the sheet P. The treatment liquid reacts with the liquid to reduce bleeding of the liquid to the sheet P.

However, the content of the pre-application process is not particularly limited to the process as described above. Further, the post-processing device may perform a sheet reversing process and a binding process to bind the multiple sheets P, for example. The sheet reversing process reverses the sheet P, on which image has been printed by the printing device 20, and conveys the reversed sheet P again to the printing device 20 to print on both sides of the sheet P.

The printing device 20 according to the first embodiment includes the discharge unit 23 to discharge a liquid. However, the printing device 20 according to the first embodiment may perform printing by a method other than the liquid discharge operation such as an electrographic method.

A sheet suction device 50 according to the first embodiment of the present disclosure is described with reference to FIGS. 3 and 4.

Figure 3:
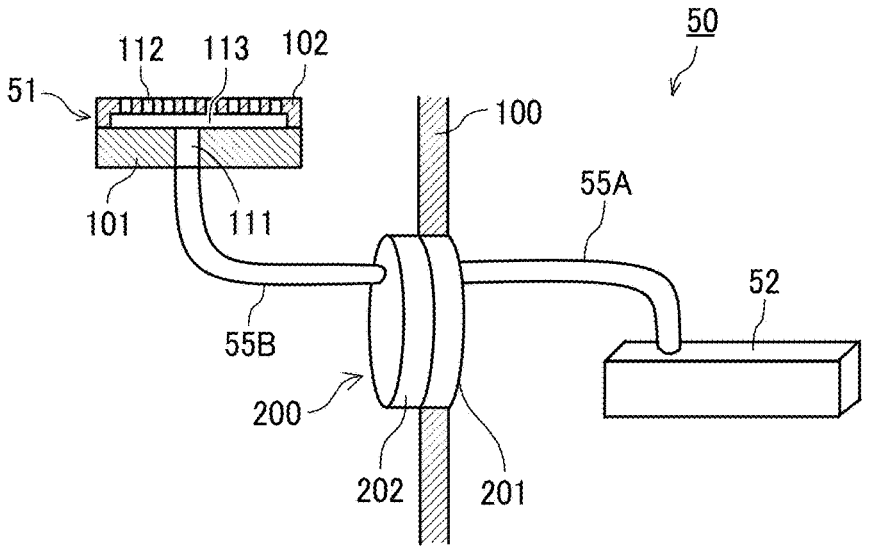
FIG. 3 is a schematic side view of an entire configuration of a sheet suction device according to the first embodiment of the present disclosure.

FIG. 3 is a schematic side view of an entire structure of the sheet suction device 50 of the printer 1.

Figure 4:
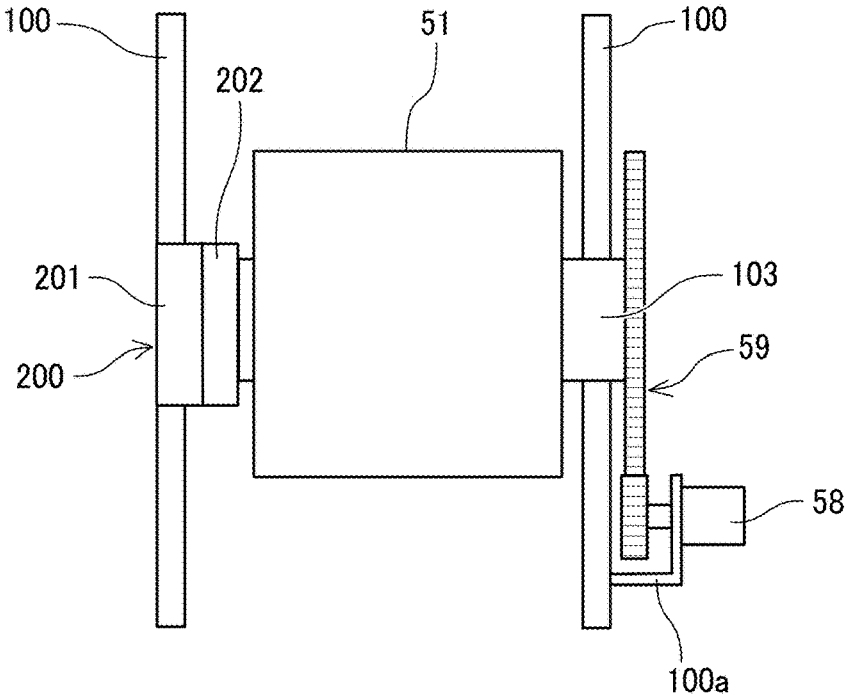
FIG. 4 is an enlarged partial schematic side view of a drive system of a drum.

FIG. 4 is an enlarged partial schematic side view of a drive system of the drum 51.

The sheet suction device 50 includes a drum 51, a suction device 52 serving as a suction unit, and a rotary valve 200 serving as a suction region switcher arranged between the drum 51 and the suction device 52. The suction device 52 and the rotary valve 200 are communicated with each other via a hose 55A (tube). The rotary valve 200 communicated with the drum 51 via a hose 55B (tube).

The rotary valve 200 includes a rotating part 202 and a fixed part 201. The rotating part 202 is a rotating member that rotates together with the drum 51. The fixing part 201 is a fixing member that is connected to the suction device 52 and does not rotate together with the drum 51. Generally, a metal plate processed into a disk shape is used for both of the rotating part 202 and the fixing part 201.

As illustrated in FIG. 3, the fixing part 201 of the rotary valve 200 is fixed to a frame 100 of the printer 1. The frame 100 supports the drum 51, the transfer cylinder 24, the discharge unit 23, and the like.

Thus, the rotary valve 200 can switch a connection and a disconnection between the suction hole 112 of the drum 51 and the suction device 52 according to a relative phase difference between the rotating part 202 and the fixing part 201. Thus, the rotary valve 200 can control a negative pressure generated on a peripheral surface of the drum 51.

The printer 1 includes the driver 58 that rotationally drives the drum 51 by transmitting a rotation of the driver 58 to a shaft 103 via a driving force transmitter 59 such as a gear train. The driver 58 is, for example, a drive motor, and is attached to a support 100*a* fixed to the frame 100.

Next, the drum 51 according to the first embodiment is described with reference to FIGS. 5 to 7.

Figure 5:
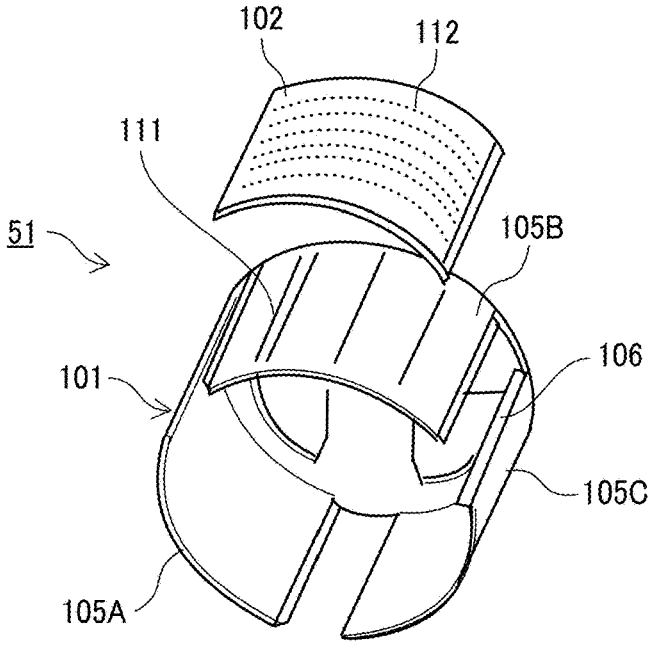
FIG. 5 is an exploded perspective view of the drum.

FIG. 5 is an exploded perspective view of the drum 51.

Figure 6:
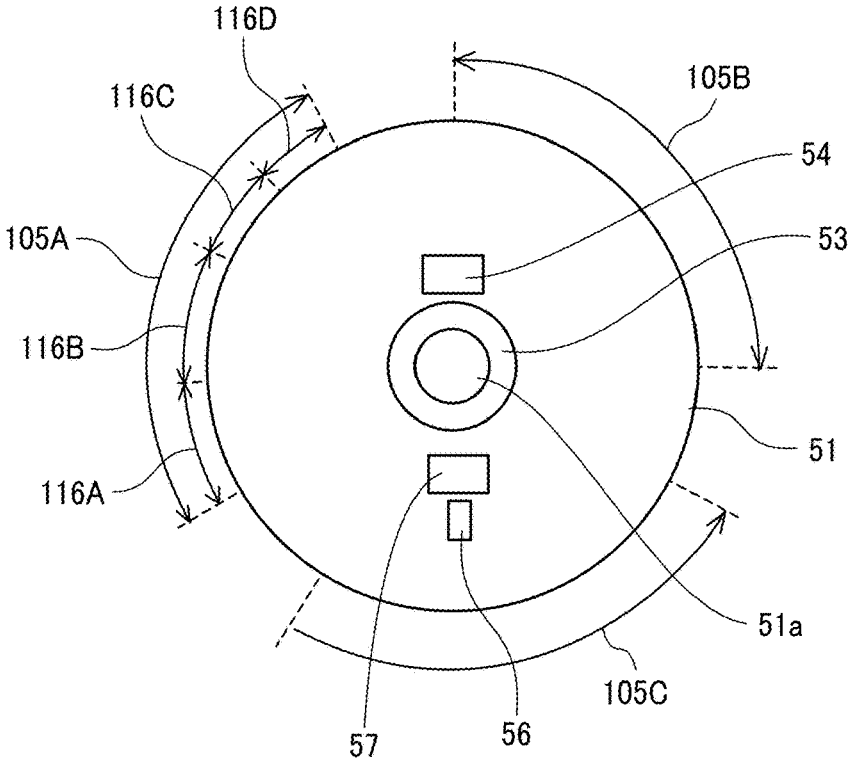
FIG. 6 is a schematic side view of the drum illustrating a bearing region, divided regions of the bearing region, and a rotation angle acquirer.

FIG. 6 is a schematic side view of the drum 51 illustrating the bearing region 105, divided regions of the bearing region 105, and a rotation angle acquirer.

Figure 7:
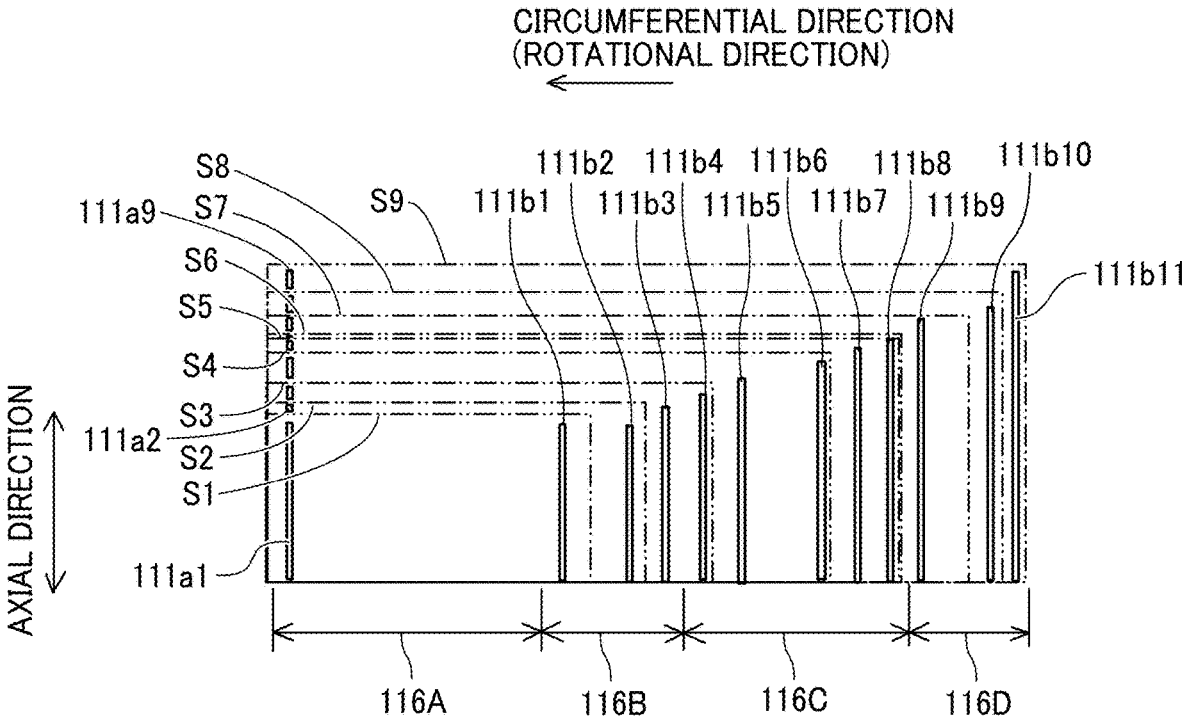
FIG. 7 is a plan view of the drum illustrating an arrangement of suction ports and a sheet size of the drum in a circumferential direction of the drum.

FIG. 7 is a plan view of the drum 51 illustrating an arrangement of suction ports 111 and a sheet size of the drum 51 in a circumferential direction of the drum 51.

The drum 51 includes a drum body 101 and a suction plate 102. A sealing material such as a rubber sheet may be interposed between the suction plate 102 and the drum body 101.

The drum 51 includes three baring regions 105 (105A to 105C) and is bearable the multiple sheets P in the circumferential direction of the drum 51. As illustrated in FIG. 4, each baring region 105 (105A to 105C) of the drum 51 includes a suction plate 102 and the drum body 101. The suction plate 102 includes multiple suction holes 112 and forms a chamber 113 communicating with each of the multiple suction holes 112. The drum body 101 includes groove shaped suction ports 111 communicating with the chamber 113. The drum 51 includes a sheet gripper 106 at a leading end of the bearing region 105 in a rotational direction of the drum 51. The sheet gripper 106 is illustrated in a simplified manner in FIG. 4.

As illustrated in FIG. 7, one bearing region 105 includes multiple sheet regions S1 to S9 corresponding to multiple (here, nine) sheet sizes. Thus, nine sheet regions S1 to S9 are allocated to one bearing region 105. Further, one bearing region 105 includes twelve suction ports 111*a*, 111*b*1 to 111*b*11 arranged in the circumferential direction (rotational direction) of the drum 51. The circumferential direction (rotational direction) is a lateral direction indicated by arrow in FIG. 7.

As illustrated in FIG. 7, the suction port 111 includes suction ports 111*a*1 to 111*a*9 arranged in an axial direction (vertical direction as indicated by arrow in FIG. 7) at a leading end in the rotational direction (left end in FIG. 7). The suction ports 111*a*1 to 111*a*9 respectively correspond to the sheet sizes S1 to S9.

For example, the drum 51 includes the suction ports 111*a*1 and 111*b*1 corresponding to the sheet region S1 (see FIG. 7). The suction ports 111*a*1 and 111*b*1 communicate with the chamber 113 to which the multiple suction holes 112 faces. The drum 51 includes the suction ports 111*a*2 and 111*b*2 communicating with the chamber 113 to which the multiple suction holes 112 in the sheet region S2 excluding the sheet region S1 faces. The same applies to other sheet regions S3 to S9.

As illustrated in FIG. 7, one bearing region 105 is divided into a first region 116A, a second region 116B, a third region 116C, and a fourth region 116D in the circumferential direction (rotational direction) from a leading end in the circumferential direction (rotational direction) of the drum 51. Here, the drum 51 rotates counterclockwise as indicated by arrows in FIG. 1.

As illustrated in FIG. 7, the first region 116A is allocated to the suction port 111*a* at the leading end (left end in FIG. 7) in the circumferential direction (rotation direction) of the drum 51. The circumferential direction (rotation direction) is leftward direction as indicated by arrow in FIG. 7. The second region 116B is allocated to the suction ports 111*b*1 to 111*b*3. The third region 116C is allocated to the suction ports 111*b*4 to 111*b*8. The fourth region 116D is allocated to the suction ports 111*b*9 to 111*b*11.

Thus, the sheet suction device 50 can connect the hose 55B to each suction port 111 (111*a* and 111*b*) on the drum 51 and switch a generation of the negative pressure to each suction port 111 (111*a* and 111*b*) to switch the suction regions.

Next, a rotation angle acquirer of the drum 51 is described below with reference to FIGS. 4 and 6 described above.

The driver 58 (drive source) supplies power to the drum 51 and the rotating part 202 of the rotary valve 200 that rotates together with the drum 51 to rotationally move.

The drum 51 includes an encoder wheel 53 that rotates in synchronization with the drum 51. The encoder wheel 53 is attached to a rotation axis 51*a* of the drum 51. The drum 51 includes a feeler 56 that rotates in synchronization with the drum 51. The feeler 56 is attached to the drum 51.

An encoder sensor 54 and a home position sensor 57 (HP sensor) are attached to the frame 100 of the printer 1. The encoder sensor 54 detects a rotation amount of the encoder wheel 53. The HP sensor 57 detects the feeler 56. The HP sensor 57 detects the feeler 56 only by one pulse (once) per one rotation of the drum 51 to detect a home position in the rotational direction of the drum 51 The encoder sensor 54 detects a rotation amount of the encoder wheel 53 to detect a relative rotation amount of the drum 51 from the home position.

The printer 1 includes a controller that combines detection results of two sensors of the encoder sensor 54 and the HP sensor 57 to detect an absolute phase (rotational phase) of the drum 51 and the rotating part 202 of the rotary valve 200 that rotates together with the drum 51.

FIGS. 8 to 14 illustrate an example of the rotary valve 200 according to a first embodiment of the present disclosure.

Figure 8:
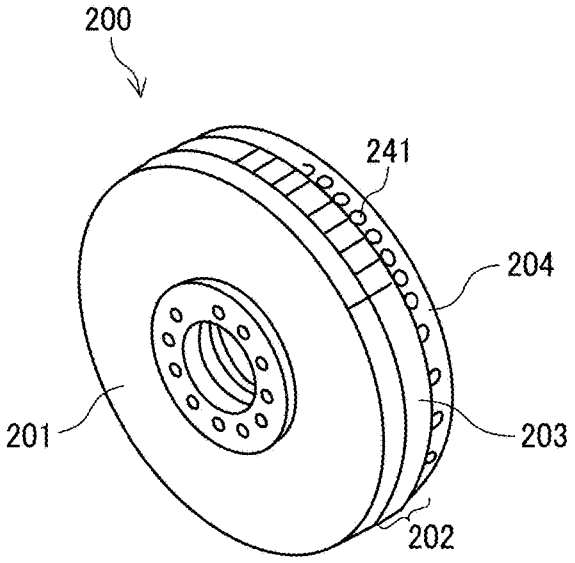
FIG. 8 is a schematic external perspective view of a rotary valve.

FIG. 8 is a schematic external perspective view of the rotary valve 200.

Figure 9:
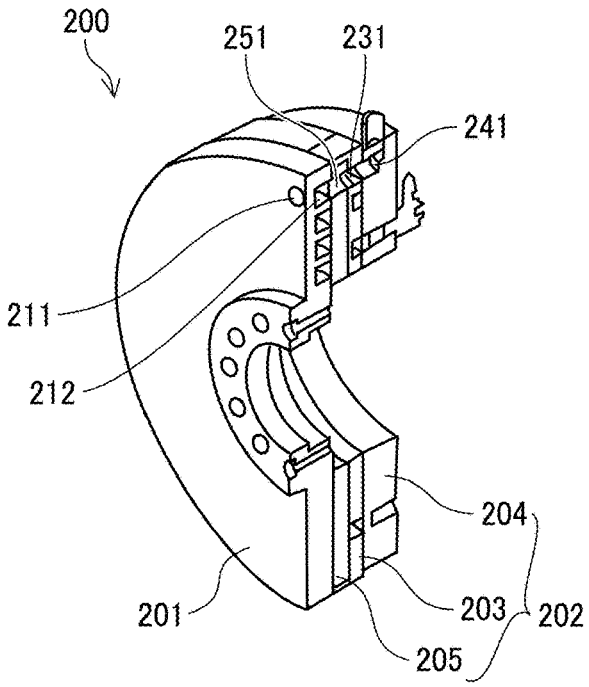
FIG. 9 is a schematic cross-sectional perspective view of the rotary valve cut in half.

FIG. 9 is a schematic cross-sectional perspective view of the rotary valve 200 cut in half.

Figure 10:
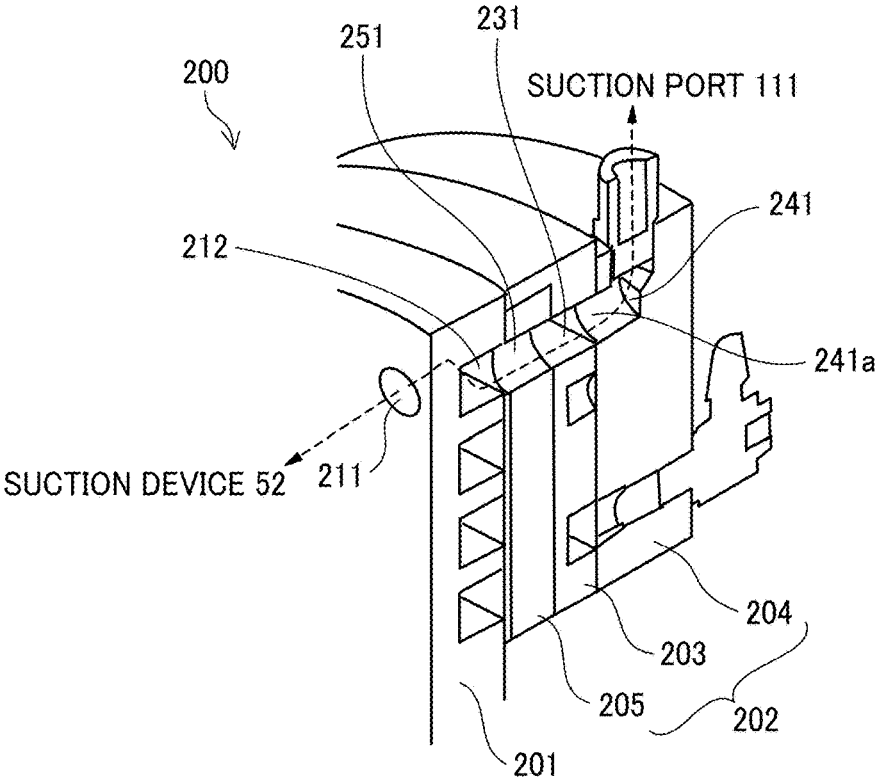
FIG. 10 is an enlarged cross-sectional perspective view of a main part of the rotary valve of FIG. 9.

FIG. 10 is a schematic enlarged cross-sectional perspective view of a main part of the rotary valve 200 cut in half.

Figure 11:
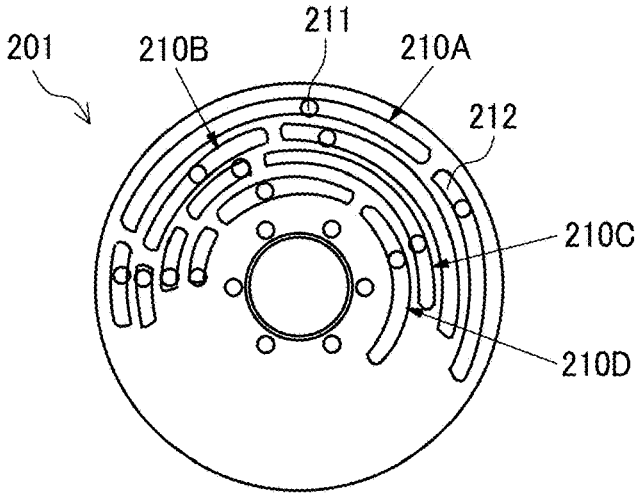
FIG. 11 is a schematic side view of a fixing part that forms the rotary valve.

FIG. 11 is a schematic side view of the fixing part 201 that forms the rotary valve 200.

Figure 12:
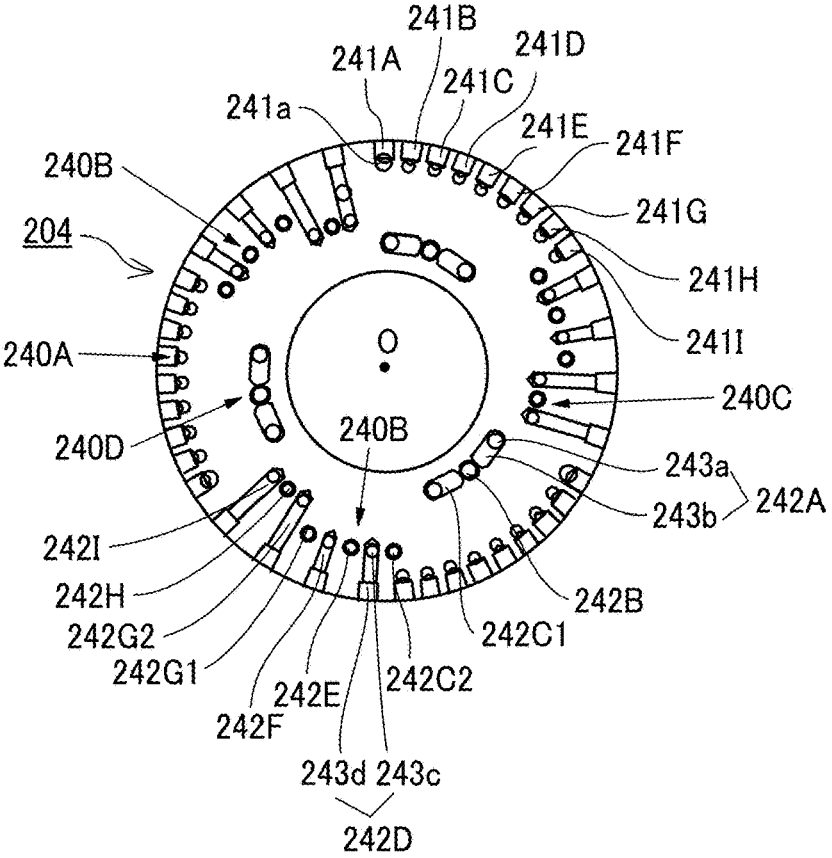
FIG. 12 is a schematic side view of a second member that forms the rotary valve.

FIG. 12 is a schematic side view of the second member 204 that forms the rotary valve 200.

Figure 13:
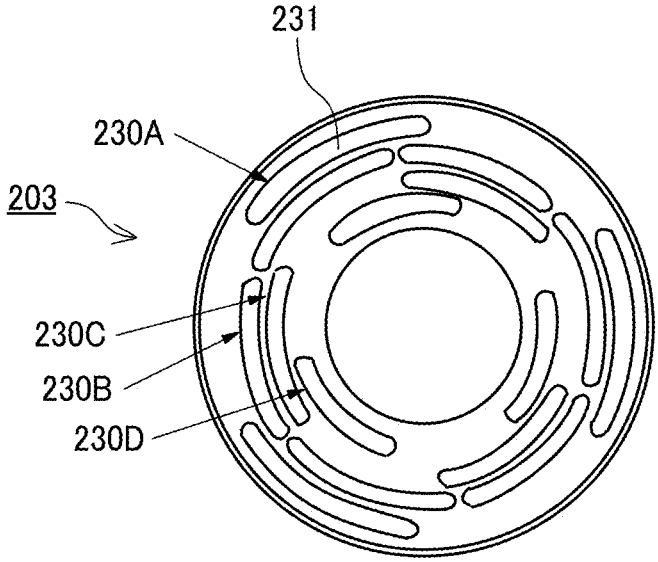
FIG. 13 is a schematic side view of a first member that forms the rotary valve.

FIG. 13 is a schematic side view of the first member 203 that forms the rotary valve 200.

Figure 14:
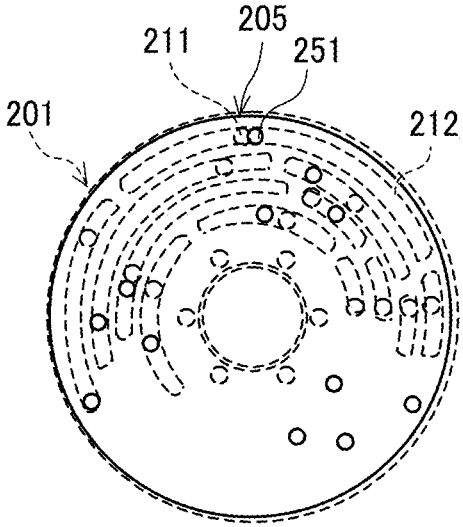
FIG. 14 is a schematic side view of a third member that forms the rotary valve.

FIG. 14 is a schematic side view of the third member 205 that forms the rotary valve 200.

As described above, the fixing part 201 of the rotary valve 200 is fixed to the frame 100 of the printer 1. The fixing part 201, the HP sensor 57, and the encoder sensor 54 may be fixed to multiple divided frames or multiple divided brackets.

The fixing part 201 includes rows of multiple grooves 212 arranged in a radial direction and divided into three parts in the circumferential direction of the fixing part 201. The rows of multiple grooves 212 are formed on a side surface of the fixing part 201 to be slidably fitted to the rotating part 202 as illustrated in FIGS. 10 and 11.

Each multiple groove 212 includes a through hole 211 to be coupled to the suction device 52. Rows of the multiple grooves 212 located on the same concentric circle are referred to as a groove row 210A, a groove row 210B, a groove row 210C, and a groove row 210D, respectively.

The rotating part 202 of the rotary valve 200 includes a first member 203, a second member 204, and a third member 205. The first member 203, the second member 204, and the third member 205 are arranged in an order of the third member 205, the first member 203, and the second member 204 from the fixing part 201 as illustrated in FIG. 8. The first member 203 has a shape covering an outer peripheral surface of the third member 205 in a radial direction of the rotary valve 200 as illustrated in FIG. 10. The third member 205 is fitted into the first member 203.

As illustrated in FIGS. 9 to 12, the second member 204 is a disk-shaped member including multiple (here, nine) holes 241 (241A to 241I) communicating with the suction port 111 of the drum 51 on a circumferential surface of the second member 204 (disk-shaped member). Each holes 241 includes an opening 241*a* on a side surface of the second member 204 contacting with the first member 203. The nine holes 241A to 241I (see FIG. 12) arranged in the circumferential direction of the second member 204 communicate with the nine suction ports 111*a* (111*a*1 to 111*a*9) arranged in the axial direction of the drum 51. The nine holes 241A to 241I are connectable to the multiple suction holes 112.

Further, the second member 204 includes multiple types of multiple holes 242 (242A to 242I) on a side surface of the second member 204 (disk-shaped member) or the like (see FIG. 12).

As illustrated in FIG. 12, each of the hole 242A and 242C1 includes a through hole 243*a* and a groove 243*b*. The through hole 243*a* penetrates through the second member 204 in an axial direction of the second member 204. The groove 243*b* extends in a circumferential direction (rotation direction) of the second member 204. Each of the holes 242B, 242C2, 242E, 242G1, and 242H includes a through hole 243*a* that penetrates through the second member 204 in an axial direction of the second member 204.

Each of the holes 242D, 242F, 242G2, and 242I includes a non-through hole 243*c* and a hole 243*d*. The non-through hole 243*c* does not penetrate through the second member 204 in the axial direction of the second member 204. The hole 243*d* extends in the radial direction of the second member 204 from the non-through hole 243*c*. The holes 242 (242A to 242I) as described above also communicates with the suction ports 111.

As illustrated in FIGS. 6 and 12, the multiple holes 241, for example, are provided for corresponding one of the bearing regions 105A, 105B, and 105C.

The first member 203 is a disk-shaped member that includes through grooves 231 along a circumferential direction on a side surface of the first member 203 (disk-shaped member). The through grooves 231 are provided for each of the bearing regions 105 (105A, 105B, and 105C, see FIGS. 6 and 13). As illustrated in FIG. 13, the first member 203 includes the through grooves 231 (230A, 230B, 230C, and 230D) at four positions that are concentric in a radial direction from an outer circumferential end toward a center of the first member 203. Each row of the through grooves 231 positioned at the same concentric circle is collectively referred to as groove rows 230A, 230B, 230C, and 230D, respectively.

With reference again to FIG. 12, rows of the holes 241 and the holes 242 of the second member 204 corresponding to the groove rows 230A to 230D of the first member 203 are respectively referred to as hole rows 240 (240A to 240D) from an outer circumference end toward the center of the second member 204. The rows of the holes 241 and the holes 242 are arranged in the circumferential direction of the second member 204.

The second member 204 includes the holes 242C1 and 242C2 (see FIG. 12). The holes 242C1 and 242C2 are two or more holes 242 that are simultaneously and respectively communicate with the groove row 230D and the groove row 230B (see FIG. 13) of the grooves 231 of the first member 203 by a rotation of the first member 203 for a unit rotation amount. The hole 242C1 belongs to the hole row 240D, and the hole 242C2 belongs to the hole row 240B.

Thus, the holes 242C1 and 242C2 (see FIG. 12) are two or more holes 242 that simultaneously communicate with the groove row 230D and the groove row 230B (see FIG. 13) of the groove 231 of the first member 203, respectively. The holes 242C1 and 242C2 are disposed at different distances from a rotation center "O" of the second member 204 (see FIG. 12). In other words, the two holes 242C1 and 242C2 respectively belong to the different hole rows 240D and 240B among the plurality of hole rows 240 arranged in the radial direction of the second member 204, and the two holes 242C1 and 242C2 simultaneously communicate with the groove row 230D and the groove row 230B of the grooves 231 of the first member 203, respectively.

Similarly, the second member 204 includes the hole 242G1 and 242G2. The hole 242G1 belongs to the hole row 240B, and the hole 242G2 belongs to the hole row 240C of the second member 204. The holes 242G1 and 242G2 are two or more holes 242 that simultaneously communicate with the groove row 230B and the groove row 230C of the grooves 231 of the first member 203, respectively, by the rotation of first member 203 for the unit rotation amount.

Thus, the holes 242G1 and 242G2 are the two or more holes 242 that simultaneously communicate with the groove row 230B and the groove row 230C of the grooves 231 of the first member 203, respectively. The holes 242G1 and 242G2 are disposed at different distances from the rotation center O of the second member 204. In other words, the two holes 242G1 and 242G2 respectively belong to the different hole rows 240B and 240C among the plurality of hole rows 240 arranged in the radial direction of the second member 204, and the two holes 242G1 and 242G2 simultaneously communicate with the groove row 230B and the groove row 230C of the grooves 231 of the first member 203, respectively.

The second member 204 thus configured includes two holes 242C1 and 242C2 or 242G1 and 242G2 simultaneously communicating with corresponding grooves 231 of the first member 203 by the rotation of the first member 203 for the unit rotation amount. Thus, the rotary valve 200 can selects one of the two holes 242C1 and 242C2 or selects one of the two holes 242G1 and 242G2 according to a size of the sheet P to be used. One of unselected two holes 242C1 and 242C2 is closed by a plug. Also, one of unselected two holes 242G1 and 242G2 is closed by a plug. Thus, the rotary valve 200 can easily change the suction region according to a type of a size of the sheet P (destination of the sheet P).

The third member 205 (see FIG. 14) having a disk shape includes a through hole 251 through which the grooves 212 of the fixing part 201 and the grooves 231 of the first member 203 communicate with each other (see FIG. 10).

The first member 203, the second member 204, and the third member 205 form the rotating part 202. The first member 203, the second member 204, and the third member 205 rotate along with a rotation of the drum 51 when the sheet P is conveyed.

When the rotary valve 200 changes (switches) the suction region (suction area), the rotary valve 200 rotates the first member 203 relative to the second member 204 and the third member 205. The second member 204 rotates together with the third member 205. Rotation of the first member 203 changes a number of holes 242 of the second member 204 communicating with the grooves 231 of the first member 203. Thus, the rotary valve 200 can change (switch) the suction region (suction area) according to the size of the sheet P (destination of the sheet P).

Next, a switching operation (size switching operation) of the suction regions (suction areas) by relative rotation of the first member 203 and the second member 204 is described with reference to FIGS. 15A to 15C and FIGS. 16A to 16C.

FIGS. 15A to 15C and 16A to 16C illustrate the switching operation (size switching operation) of the suction region (suction area) by the relative rotation of the first member 203 and the second member 204.

Figure 15:
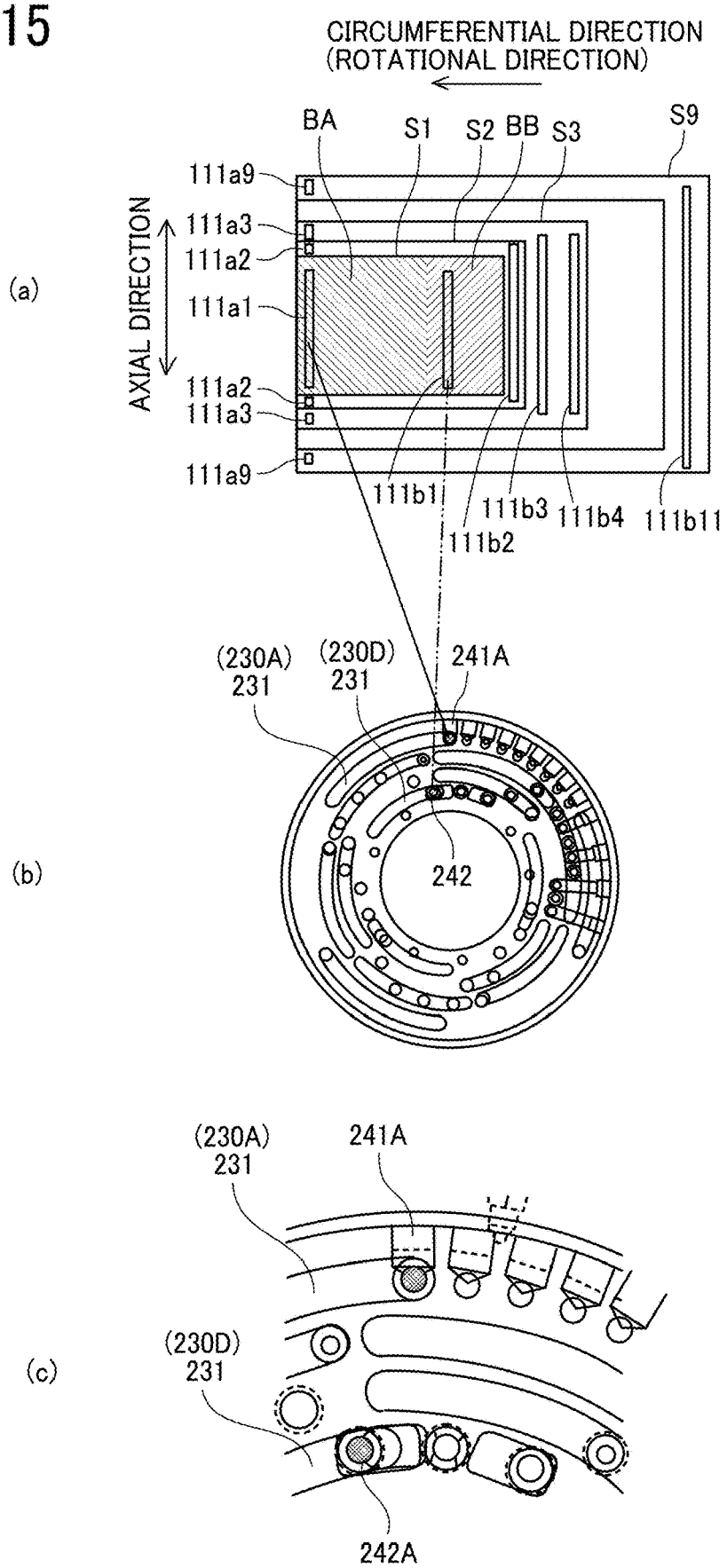
FIGS. 15(*a*) to 15(*c*) are schematic plan view and side views of the rotary valve illustrating changing of suction regions (size changing) by relative rotation of the first member and the second member.
Figure 16:
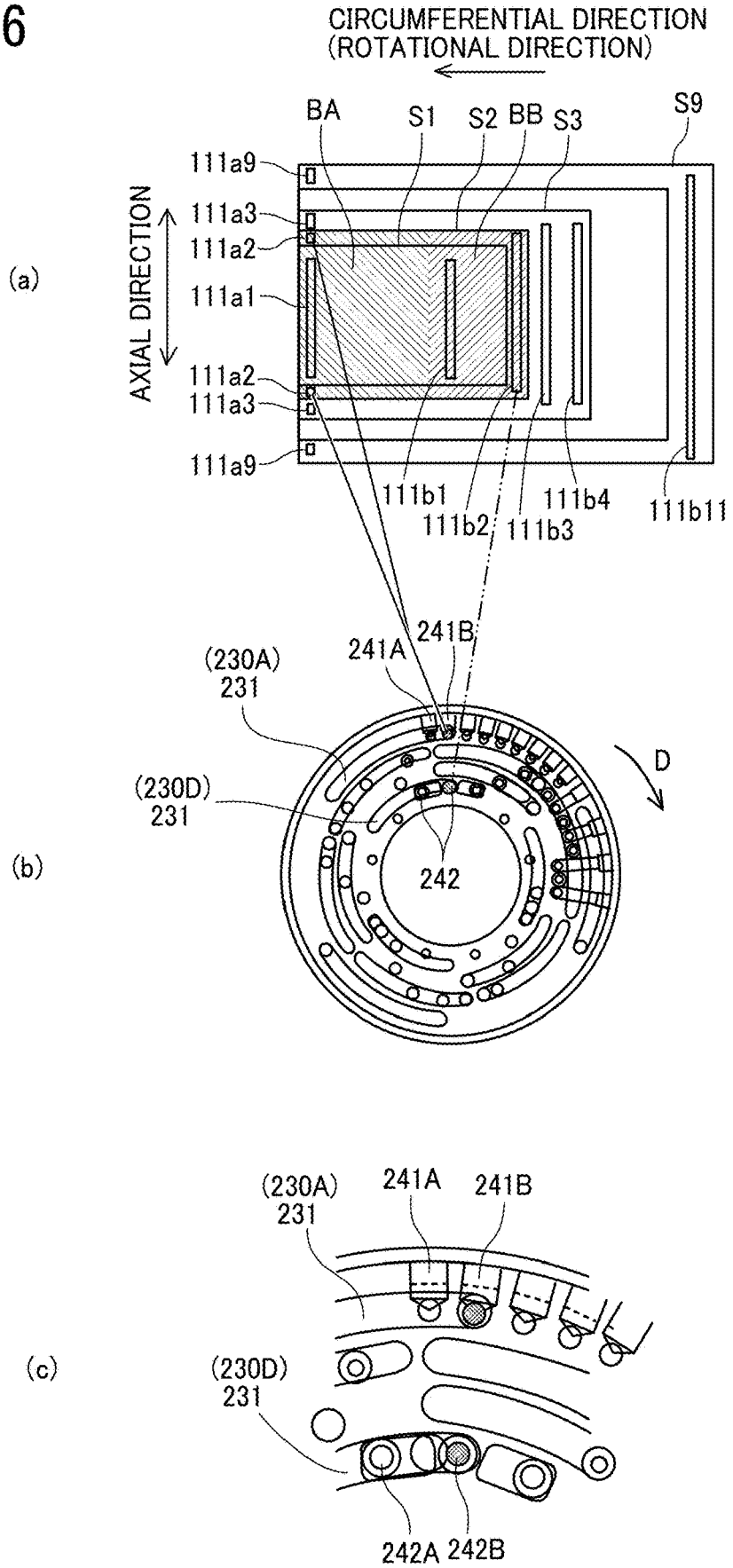
FIGS. 16(*a*) to 16(*c*) are schematic plan view and side views of the rotary valve illustrating changing of suction regions (size changing) by relative rotation of the first member and the second member.

FIGS. 15A and 16A are schematic plan views of the drum 51 illustrating the size of the sheet P and the suction ports 111 on the drum 51.

FIGS. 15B and 16B are schematic transparent side views of the first member 203 and the second member 204.

FIGS. 15C and 16C are enlarged transparent side views of the first member 203 and the second member 204 in FIGS. 15B and 16B.

As described above, the nine holes 241A to 241I (see FIG. 12) in the circumferential direction of the second member 204 communicate with the nine suction ports 111*a* (111*a*1 to 111*a*9) of the drum 51.

Therefore, a number of holes 242 of the second member 204 (number of suction ports 111*a* of the drum 51) communicating with the groove 231*a* of the groove row 230A of the first member 203 is switched (changed) to switch (change) the size of the suction region (suction area) in the axial direction of the drum 51. The axial direction of the drum 51 is orthogonal to the circumferential direction of the drum 51 (see FIGS. 15A and 16A).

That is, the number of holes 242 of the second member 204 (number of suction ports 111*a* of the drum 51) communicating with the grooves 231 of the first member 203 is switched (changed) to switch (change) the number of the suction holes 112 facing the chamber 113 with which the suction ports 111*a* of the drum 51 communicate.

The holes 242 of the second member 204 (suction ports 111*b* (111*b*1 to 111*b*11) of the drum 51) communicate with any one of the groove rows 230B to 230D of the first member 203.

Therefore, the number of suction ports 111*b* (111*b*1 to 111*b*11) of the drum 51 communicating with the groove 231 of the groove rows 230B to 230D of the first member 203 via the holes 242 of the second member 204 is switched (changed) to switch (change) the size of the suction region (suction area) in the circumferential direction of the drum 51.

The number of holes 242 of the second member 204 (number of suction ports 111*b* of the drum 51) communicating with the grooves 231 of the first member 203 is switched (changed) to switch (change) the number of the suction holes 112 facing the chamber 113 with which the suction ports 111*b* of the drum 51 communicate.

As illustrated in FIGS. 15B and 15C, for example, a relative positional relation between the first member 203 and the second member 204 is set to a state in which the groove 231 of the groove row 230A of the first member 203 communicates with the hole 241A of the second member 204, and the groove 231 of the groove row 230D of the first member 203 communicates with the hole 242 of the second member 204.

Thus, the suction device 52 communicates with the suction port 111*a*1 of the drum 51. Further, the suction device 52 communicates with the suction ports 111*b*1 of the drum 51.

Thus, as illustrated in FIG. 15A, the suction device 52 sucks air through the suction holes 112 (see FIG. 5) belonging to a region BA communicating with the suction port 111*a*1 and a region BB communicating with the suction port 111*b*1 so that the suction device 52 can suck the air in the suction region (suction area) of the sheet region S1.

From the state as illustrated in FIG. 16A, the first member 203 is rotated in a direction indicated by arrow "D" (clockwise direction) with respect to the second member 204 as illustrated in FIGS. 16B and 16C. Thus, the relative positional relation between the first member 203 and the second member 204 becomes a state in which the groove 231 of the groove row 230A of the first member 203 communicates with the two holes 241A and 241B of the second member 204, and the groove 231 of the groove row 230D of the first member 203 communicates with the two holes 242A and 242B of the second member 204.

Note that shaded circles in FIGS. 16B and 16C indicate the holes 241 and 242 (i.e., hole 241B and 242B) that are new holes 241 and 242 of the second member 204 communicating with the grooves 231 of the first member 203.

Then, the suction device 52 communicates with the suction ports 111*a*1 and 111*a*2 of the drum 51. Further, the suction device 52 communicates with the suction ports 111*b*1 and 111*b*2 of the drum 51.

Thus, as illustrated in FIG. 16A, the suction device 52 sucks air through the suction holes 112 (see FIG. 5) belonging to the region BA communicating with the suction port 111*a*1 and 111*a*2 and the region BB communicating with the suction port 111*b*1 and 111*b*2 of the drum 51 so that the suction device 52 can suck the air in the suction region (suction area) of the sheet region S2 having an area larger than the sheet region S1. The sheet region S1 is the smallest sheet region, and the sheet region S2 is a second smallest sheet region among the sheet regions S1 to S9.

Similarly, the relative positional relation between the first member 203 and the second member 204 is switched (changed) to change the number of the suction holes 112 of the drum 51 communicating with the suction device 52 to change the suction region (suction area). The relative positional relation between the first member 203 and the second member 204 is the relative positional relation between the first member 203 and the drum 51.

Next, the switching operation of the suction region (suction area) by the first member 203 is described with reference to FIGS. 17 and 18.

Figure 17:
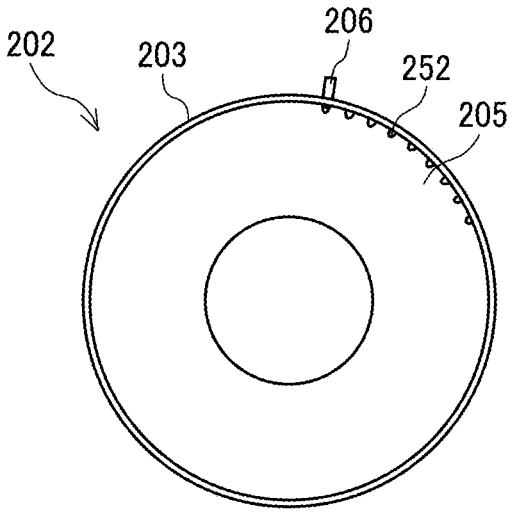
FIG. 17 is a schematic side view of a rotating part of the rotary valve.

FIG. 17 is a schematic side view of the rotating part 202 of the rotary valve 200.

Figure 18:
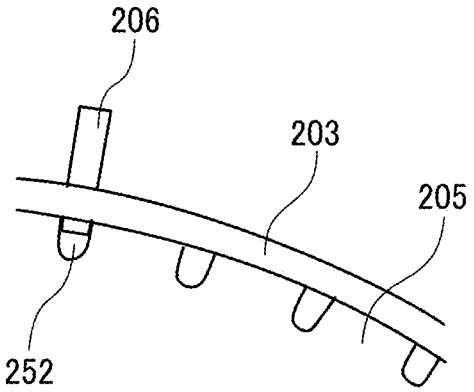
FIG. 18 is an enlarged side view of a main part of the rotating part.

FIG. 18 is an enlarged side view of a main part of the rotating part 202.

The first member 203 is rotatable so that the first member 203 is rotated to switch (change) the suction region (suction area) of drum 51 sucked by the suction device 52. A plunger 206 is used to determine a rotation position of the first member 203. Specifically, a leading end of the plunger 206 is fitted into holes 252 formed on a circumferential surface of the third member 205 according to each position of the suction region to determine a position of the suction region.

To perform a rotating operation of the first member 203, the user pulls out the plunger 206 from the hole 252 and rotates the first member 203 relative to the second member 204 and the third member 205 until the first member 203 reaches to a target position. Then, the user inserts the leading end of the plunger 206 into the hole 252 at the target position.

Next, an automatic rotation mechanism 300 of the first member 203 according to the first embodiment of the present disclosure is described with reference to FIGS. 19 and 20.

Figure 19:
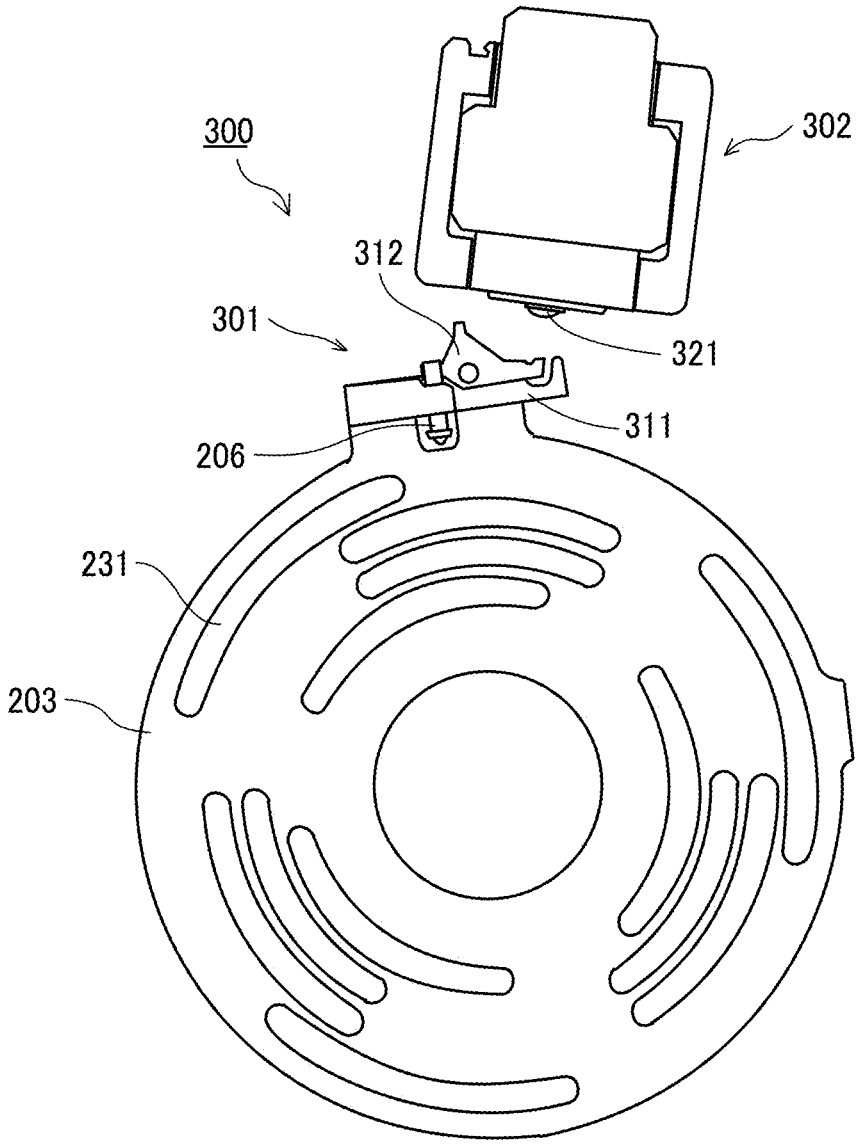
FIG. 19 is a schematic side view of the automatic rotation mechanism according to the first embodiment.

FIG. 19 is a schematic side view of the automatic rotation mechanism 300 according to the first embodiment.

Figure 20:
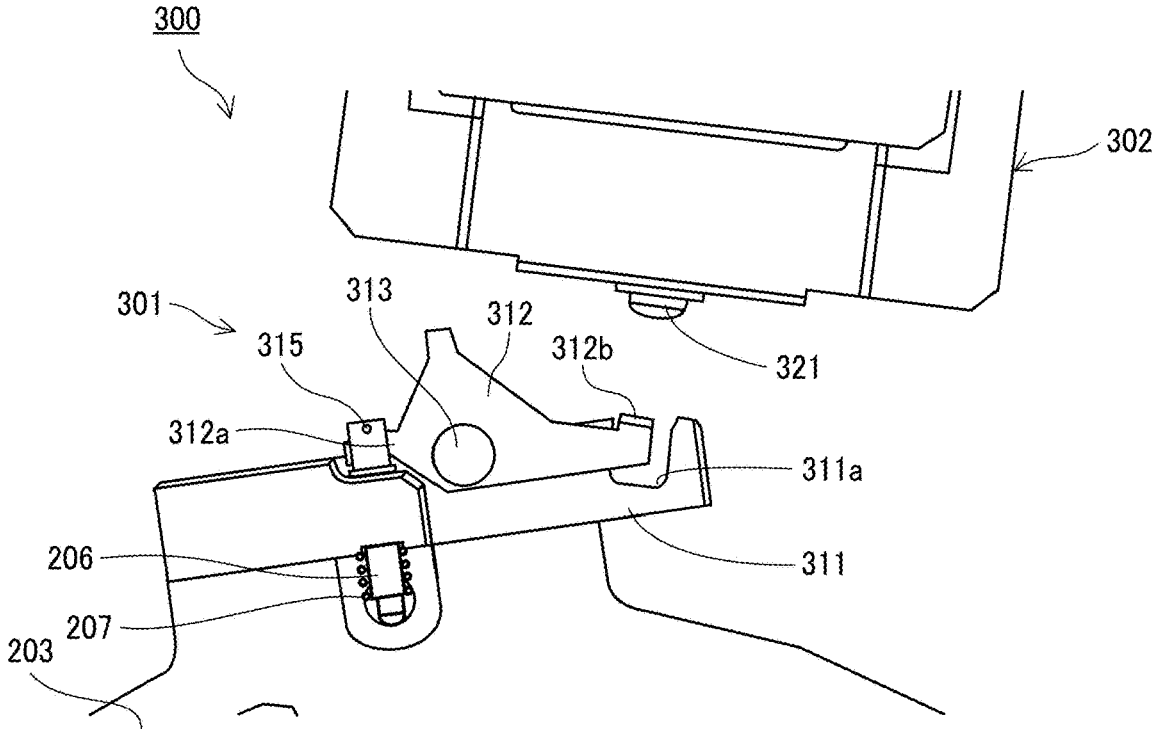
FIG. 20 is an enlarged partial side view of the automatic rotation mechanism according to the first embodiment.

FIG. 20 is an enlarged partial side view of the automatic rotation mechanism 300 according to the first embodiment.

Circumferential positions of the through grooves 231 of the groove rows 230A, 230B, 230C, and 230D of the first member 203 are different from the circumferential positions of the through grooves 231 as illustrated above in FIG. 13 and the like. However, an effect of the though grooves 231 illustrated in FIGS. 19 and 20 is the same as an effect of the though grooves 231 illustrated in FIG. 13.

The automatic rotation mechanism 300 is a restrictor to restrict a rotation of the first member 203. The automatic rotation mechanism 300 includes a lever mechanism 301 and a linear-motion mechanism 302.

The lever mechanism 301 is a holder to hold a relative phase between the first member 203 and the drum 51 serving as the bearer (carrying member). The linear-motion mechanism 302 is a releaser to release a holding (restricting) state of the lever mechanism 301 (holder) so that the first member 203 can rotate relative to the drum 51.

Thus, the restrictor (automatic rotation mechanism 300) includes a holder (lever mechanism 301) configured to hold a relative phase between the first member 203 and the drum 51, and a releaser (linear-motion mechanism 302) configured to release the holder (lever mechanism 301) to cause the first member 203 and the drum 51 to be relatively rotatable.

The lever mechanism 301 includes a block 311 having a recess 311*a*. A lever 312 is rotatably attached to the block 311 by a support shaft 313.

The lever mechanism 301 includes a plunger 206 to restrict a movement of the first member 203. The plunger 206 is attached to a leading end 312*a* (one end that is a left end in FIG. 20) of the lever 312. The plunger 206 can move together with a pin 315. A rear end 312*b* (another end that is a right end in FIG. 20) of the lever 312 faces the recess 311*a* of the block 311.

The plunger 206 is reciprocally movably inserted into a guide hole in the block 311. The plunger 206 is biased toward the hole 252 of the third member 205 by a spring 207.

The linear-motion mechanism 302 is fixed to the frame 100. The linear-motion mechanism 302 includes a piston 321 that linearly reciprocally moves by an internal drive source. The piston 321 is advanceably retractable with respect to the recess 311*a* of the block 311 of the lever mechanism 301. The piston 321 can contact and push the rear end 312*b* of the lever 312.

The piston 321 has a cylindrical shape, and a tip of the piston 321 has a tapered shape. The spring 207 and the linear-motion mechanism 302 form a single actuator 804 (see FIG. 24). The actuator 804 restricts (holds) a movement of the first member 203 by a holder (lever mechanism 301) and releases a restriction (holding) of the holder (lever mechanism 301).

Thus, the holder (lever mechanism 301) includes the lever 312 rotatable about the support shaft 313, and the plunger 206 attached to one end (leading end) of the lever 312. The plunger 206 is configured to restrict the rotation of the first member 203. The releaser (linear-motion mechanism 302) includes the piston 321 advanceably retractable to push another end (rear end) of the lever 312 to allow the rotation of the first member 203.

The linear-motion mechanism 302 serving as a part of the single actuator 804 may restrict and release the first member 203 by the lever mechanism 301 serving as the holder.

Next, an operation of the automatic rotation mechanism 300 is described below with reference to FIGS. 21 and 22.

Figure 21:
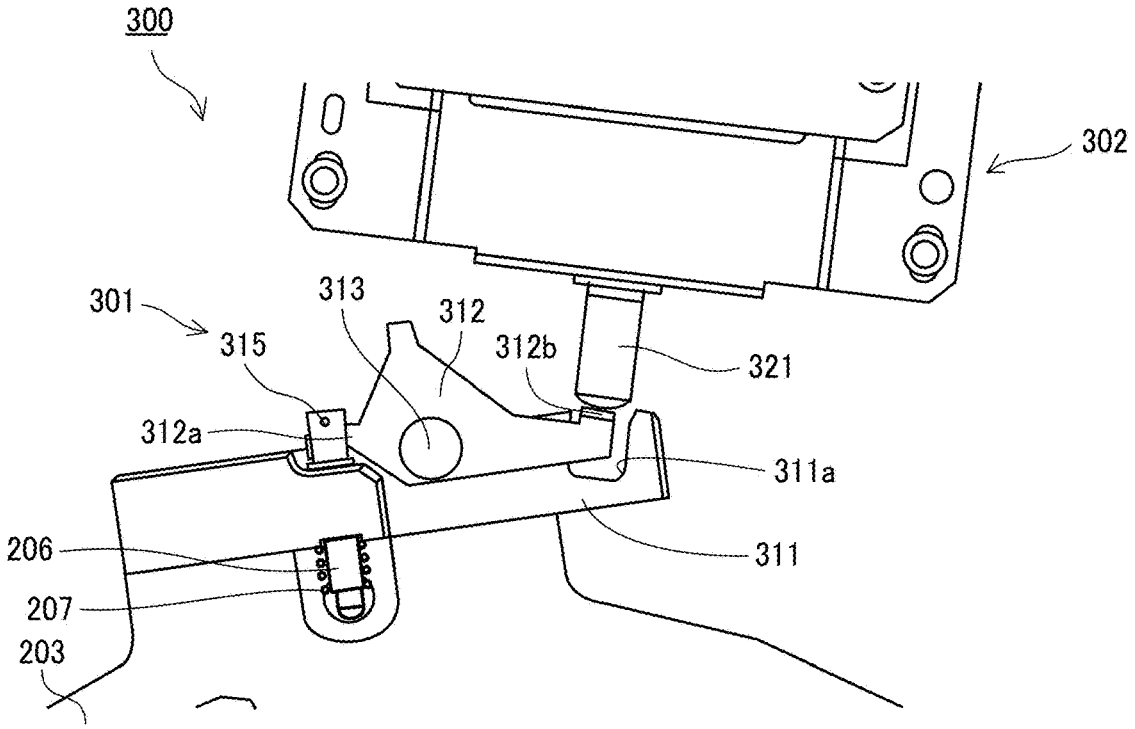
FIG. 21 is an enlarged partial side view of the automatic rotation mechanism according to the first embodiment illustrating an operation of the automatic rotation mechanism.
Figure 22:
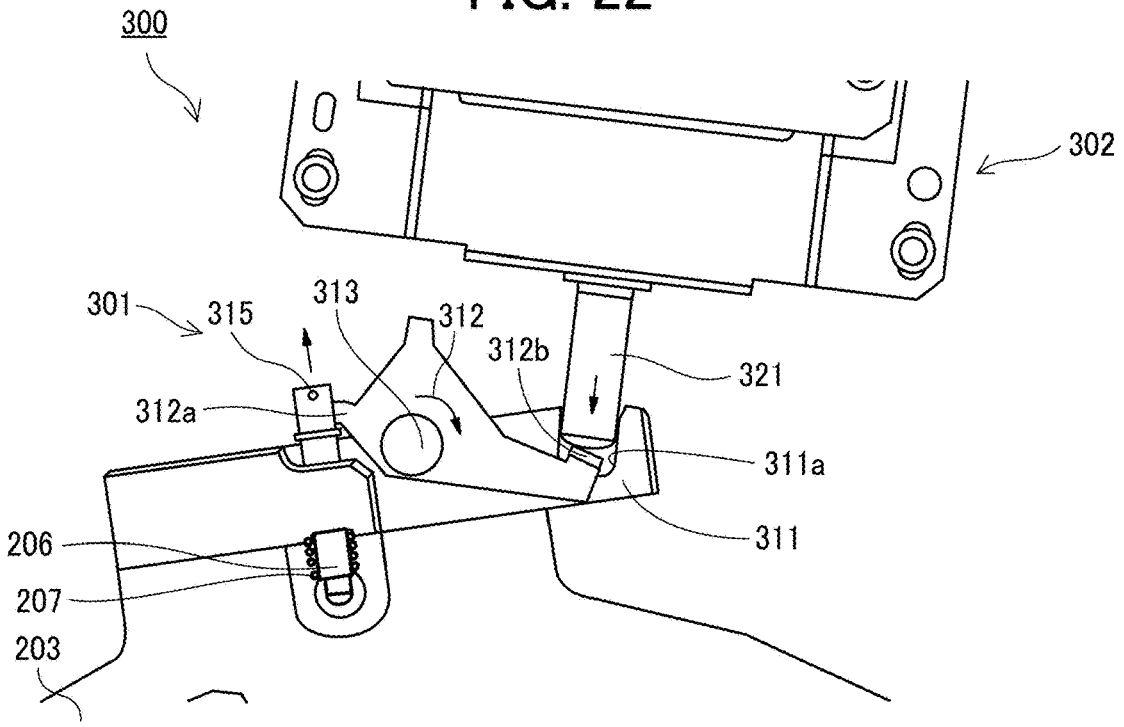
FIG. 22 is an enlarged partial side view of the automatic rotation mechanism according to the first embodiment illustrating an operation of the automatic rotation mechanism.

FIGS. 21 and 22 are enlarged partial side views of the automatic rotation mechanism 300 illustrating the operation of the automatic rotation mechanism 300.

The automatic rotation mechanism 300 drives the linear-motion mechanism 302 to advance the piston 321 to rotate the first member 203. The piston 321 advances toward the first member 203 and comes into contact with the rear end 312*b* of the lever 312 as illustrated in FIG. 21.

The piston 321 further advances to push the rear end 312*b* of the lever 312 to rotate the lever 312 about the support shaft 313 in a clockwise direction indicated by arrow as illustrated in FIG. 22. The plunger 206 moves in an upward direction indicated by arrow in FIG. 22 in conjunction with the rotation of the lever 312.

Thus, the plunger 206 comes out of the hole 252 of the third member 205 as described above with reference to FIG. 18 so that a locked state between the first member 203 and the drum 51 is released. Therefore, the first member 203 and the drum 51 become relatively rotatable.

In this state (the first member 203 and the drum 51 become relatively rotatable), the piston 321 is fitted into the recess 311*a* of the block 311, and the lever 312 is prevented from rotating as illustrated in FIG. 22.

Therefore, the driver 58 (drive source) of the drum 51 is driven to relatively rotate the first member 203 and the drum 51 (second member 204).

The automatic rotation mechanism 300 drives and controls the actuator and drives and controls the driver 58 that rotates the drum 51 to rotate the first member 203 relative to the drum 51 so that the automatic rotation mechanism 300 can automatically change the suction region (suction area) in response to changing of the sheet size.

Although the lever 312 is used as an example of a device to pull out the plunger 206 from the hole 252, a wedge and the like may be used to pulled out the plunger 206 from the hole 252.

Next, a configuration for acquiring information on a relative phase (relative angle) between the first member 203 and the drum 51 is described with reference to FIG. 23.

Figure 23:
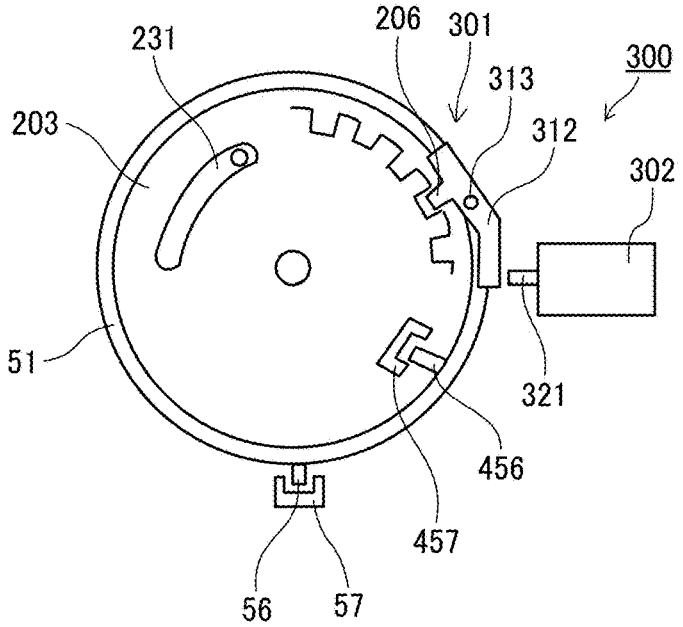
FIG. 23 is a schematic side view of the automatic rotation mechanism illustrating an acquisition of information on the relative phase (relative angle) between the first member and the drum.

FIG. 23 is a schematic side view of the automatic rotation mechanism 300 illustrating an acquisition of information on the relative phase (relative angle) between the first member 203 and the drum 51. Note that, the first member 203 is illustrated in a simplified manner in FIG. 23.

As described above with reference to FIG. 6, the drum 51 includes the encoder sensor 54 and the HP sensor 57. The encoder sensor 54 detects the encoder wheel 53 that rotates in synchronization with the drum 51. The HP sensor 57 detects the feeler 56 that rotates in synchronization with the drum 51. A phase of the drum 51 can be acquired from the detection results of the encoder sensor 54 and the HP sensor 57.

The first member 203 has the same configuration with the drum 51 as described above. For example, the first member 203 includes a feeler 456, and a home position (HP) sensor 457 is provided on the frame 100.

Accordingly, a phase difference between the first member 203 and the drum 51 can be calculated based on each detection signal of the HP sensor 57 of the drum 51 and the HP sensor 457 of the first member 203, and an encoder signal from the encoder sensor 54 of the drum 51 so that a current setting of the sheet size can be acquired.

A size information of the sheet P included in a print command received by the printer 1 is compared with a setting state of the first member 203. When the result of a comparison is a mismatch (unmatched), the printer 1 stops printing and notify the mismatch to a matching controller 801 of the printer 1 as described below.

Next, the sheet conveyor 21 according to a second embodiment of the present disclosure is described with reference to FIG. 24.

Figure 24:
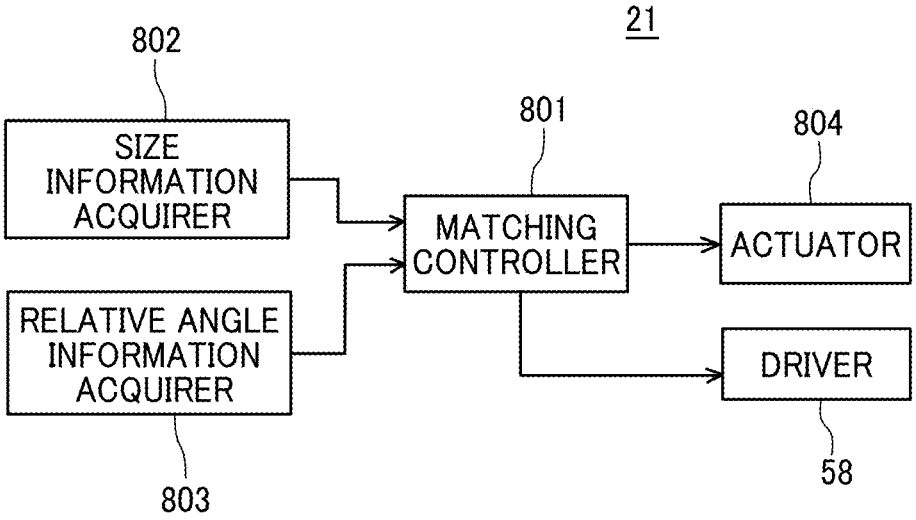
FIG. 24 is a block diagram illustrating a configuration of the sheet conveyor according to the second embodiment.

FIG. 24 is a block diagram illustrating a configuration of the sheet conveyor 21 according to the second embodiment.

The sheet conveyor 21 according to the second embodiment includes the matching controller 801, a size information acquirer 802, and a relative angle information acquirer 803.

The size information acquirer 802 acquirers size information of the sheet P to be conveyed. For example, the size information acquirer 802 acquirers the size information of the sheet P (size of the sheet P) included in the print command received by the printer 1.

The relative angle information acquirer 803 acquires information on a number of suction holes 112 changed by the relative rotation between the first member 203 and the drum 51 (bearer or carrying member).

The matching controller 801 compares the size information (size of the sheet P) obtained by the size information acquirer 802 and information of the number of suction holes 112 (suction area covered by the number of suction holes) obtained by the relative angle information acquirer 803 to determine whether a mismatch occurs between the size information (size of the sheet P) and the suction area covered by the number of suction holes 112.

When there is the mismatch between the size information (size of the sheet P) and the suction area covered by the number of suction holes 112, the matching controller 801 controls to perform a matching operation before the sheet conveyor 21 starts a sheet conveyance operation. The matching operation changes the relative phase between the first member 203 and the drum 51 to match the size information and the number of suction holes 112.

The matching controller 801 drives an actuator 804 to rotate the lever 312 of the lever mechanism 301 to bring the first member 203 into a rotatable state in a control of the matching operation as described in the first embodiment.

Then, the matching controller 801 drives and controls the driver 58 to rotate the drum 51 to rotate the first member 203 relative to the drum 51 to match the size information with the number of suction holes 112 (suction area).

Thus, the sheet conveyor 21 includes a size information acquirer 802 configured to acquire a size of the sheet P, a relative angle information acquirer 803 configured to acquire a number of the multiple suction holes 112 changed by a relative rotation between the first member 203 and the drum 51, and a matching controller 801. The matching controller 801 is configured to compare the size of the sheet and an area covered by the number of the multiple suction holes to determine whether a mismatch occurs, and control the driver 58 and the actuator 804 to change a relative phase of the first member 203 to be matched with a relative phase of the drum 51 in response to an occurrence of the mismatch.

In the above way, the automatic rotation mechanism 300 can automatically perform switching (changing) of the suction region (suction area) so that the automatic rotation mechanism 300 can enable the user to easily switch the suction region.

Each of the functions of the described embodiments such as the matching controller 801 may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet suction device comprising:

a drum including multiple suction holes in a circumferential surface of the drum, the drum to bear a sheet on the circumferential surface and rotate;

a rotary valve between the multiple suction holes of the drum and a suction path, the rotary valve to rotate relative to the drum to change a number of the multiple suction holes communicating with the suction path; and a driver to relatively rotate the drum and the rotary valve, wherein the rotary valve comprises:

a first member which receives suction; and a second member contacting the first member, the second member communicating with the multiple suction holes, and wherein the driver is to rotate the first member, the sheet suction device further comprising a restrictor to restrict a rotation of the first member, the restrictor including:

a holder to hold a relative phase between the first member and the drum; and a releaser to release the holder to cause the first member and the drum to be relatively rotatable, wherein the holder includes:

a lever rotatable about a support shaft; and a plunger attached to one end of the lever, the plunger is to restrict the rotation of the first member, wherein the releaser includes a piston advanceably retractable to push another end of the lever to allow the rotation of the first member.

2. A sheet conveyor comprising the sheet suction device according to claim 1.

3. A sheet conveyor, comprising:

a sheet suction device including:

a drum including multiple suction holes in a circumferential surface of the drum, the drum to bear a sheet on the circumferential surface and rotate;

a rotary valve between the multiple suction holes of the drum and a suction path, the rotary valve to rotate relative to the drum to change a number of the multiple suction holes communicating with the suction path; and a driver to relatively rotate the drum and the rotary valve, wherein the rotary valve comprises:

a first member which receives suction; and a second member contacting the first member, the second member communicating with the multiple suction holes, and wherein the driver is to rotate the first member, the sheet conveyor further comprising:

relative angle information acquiring circuitry configured to acquire a number of the multiple suction holes changed by a relative rotation between the first member and the drum; and a matching controller configured to:

compare a size of the sheet and an area covered by the number of the multiple suction holes to determine whether a mismatch occurs; and control the driver to change a relative phase of the first member to be matched with a relative phase of the drum in response to an occurrence of the mismatch.

4. A printer comprising:

the sheet conveyor according to claim 3; and a liquid discharge head to discharge a liquid onto the sheet conveyed by the sheet conveyor.

5. A sheet suction device comprising:

a drum including multiple suction holes in a circumferential surface of the drum, the drum configured to bear a sheet on the circumferential surface and rotate;

a rotary valve between the multiple suction holes of the drum and a suction path, the rotary valve to rotate relative to the drum to change a number of the multiple suction holes communicating with the suction path;

a driver to relatively rotate the drum and the rotary valve;

a movable lever;

indents in the rotary valve; and an actuator to move the movable lever such that when the movable lever is in a first position, the rotary valve is not changeable relative to the drum, and when the rotary valve is in a second position, the rotary valve is changeable relative to the drum.

6. A sheet conveyor comprising the sheet suction device according to claim 5.

7. A printer comprising:

the sheet conveyor according to claim 6; and a liquid discharge head to discharge a liquid onto the sheet conveyed by the sheet conveyor.

* * * * *